United States Patent [19]

Gancy et al.

[11] 4,116,62

[45] Sep. 26, 197

[54] CORROSION INHIBITION OF STAINLESS STEEL EXPOSED TO HOT CARBONATES

[75] Inventors: Alan Brian Gancy, Syracuse; Robert Edward Durling, Camillus, both of N.Y.

[73] Assignee: Allied Chemical Corporation, Morris Township, Morris County, N.J.

[21] Appl. No.: 801,947

[22] Filed: May 31, 1977

[51] Int. Cl.[2] ..... C23F 11/06; C23F 11/18

[52] U.S. Cl. ..... 422/13; 252/387

[58] Field of Search ..... 21/2.7 R; 252/387; 448/6.11, 6.14 R

[56] References Cited

U.S. PATENT DOCUMENTS

| | | | |
|---|---|---|---|
| 2,957,762 | 10/1960 | Young | 252/387 |
| 3,024,201 | 3/1962 | Bregman | 21/2.7 R |
| 3,079,220 | 2/1963 | Boes et al. | 21/2.7 R |
| 3,151,087 | 9/1964 | Ryznar et al. | 252/38 |
| 3,625,888 | 12/1971 | Redmore et al. | 21/2.7 I |
| 3,699,052 | 10/1972 | Petrey et al. | 21/2.7 I |
| 3,721,526 | 3/1973 | Foroults et al. | 21/2.7 I |
| 3,738,806 | 6/1973 | Feiler | 21/2.7 I |
| 3,901,651 | 8/1975 | Benner et al. | 21/2.7 I |
| 3,951,844 | 4/1976 | Mago | 252/38 |

*Primary Examiner*—Morris O. Wolk
*Assistant Examiner*—Bradley Garris
*Attorney, Agent, or Firm*—Anthony J. Stewart; Gerard P. Rooney

[57] ABSTRACT

A method for inhibiting the corrosion of martensiti and ferritic stainless steel surfaces which are exposed t hot carbonate solutions which comprises contactin said stainless steel surfaces with nickel ions and prefera bly with at least 10 ppm of nickel ion contained in th hot alkali metal carbonate solution.

13 Claims, No Drawings

CORROSION INHIBITION OF STAINLESS STEEL EXPOSED TO HOT CARBONATES

BACKGROUND OF THE INVENTION

1. FIELD OF THE INVENTION

This invention is related to the inhibition of corrosion of stainless steel surfaces, and more particularly to methods for inhibiting the corrosion of stainless steel surfaces which are exposed to hot alkali metal carbonate solutions in industrial processes.

2. DESCRIPTION OF THE PRIOR ART

This invention is particularly concerned with processes such as the manufacture of synthesis gas by the partial oxidation of sulfur-containing crude oil, in which the crude synthesis gas is scrubbed with carbonate solution to remove carbon dioxide together with a minor but highly significant proportion of hydrogen sulfide.

The removal of weakly acidic gases from process gas streams by the use of hot potassium carbonate solution as an aqueous absorbent solution has assumed increasing importance in recent years. Operating details of a typical process of this nature are described in U.S. Pat. No. 2,886,405. The process generally consists of a gas-scrubbing step at elevated pressure, during which the aqueous carbonate solution absorbs the weakly acidic gas or gases from the gas stream, followed by a separate regeneration step at lower pressure whereby the weakly acidic gas is removed from the liquid solution. The regenerated solution is then recycled to the gas-scrubbing step. Typical acidic gases which are removed from process gas streams in this manner include carbon dioxide, hydrogen sulfide, hydrogen cyanide and carbonyl sulfide. The potassium carbonate content of these solutions can vary within a range of about 20 to about 40 percent, depending upon the individual installation, and may contain monoethanolamine, diethanolamine, amine borates, and the like to assist gaseous absorption. In all of these compositions however, the absorbing solutions are very corrosive to ferrous metals with which they come into contact.

The process is generally carried out in carbon steel vessels, with stainless steel being employed at critical points. It has been found that chromium-nickel stainless steel, which has an austenitic metallurgical structure, while satisfactorily corrosion resistant, suffers the disadvantage of having a relatively high susceptibility to stress-corrosion cracking. For this reason chromium stainless steels, i.e., those having a martensitic or ferritic metallurgical structure, are sometimes used and corrosion of process equipment is a significant operating problem. It has heretofore been alleviated or prevented by the addition of various compounds or agents to the circulating carbonate solution. Among these may be mentioned chromates, silicates, and organic agents such as film-forming, highly polar aliphatic polyamines having two or more amino groups located at the ends of long hydrocarbon chains.

Numerous investigators have studied the corrosion of aqueous poassium carbonate solutions and the incorporation of additives in them for corrosion prevention. For example Bienstock and Field repoted in Corrosion, Vol. 17, page 337*t* (1961) that higher concentrations of potassium carbonate were more corrosive than lower concentrations and that sparging with carbon dioxide greatly increased this corrosion. Analysis of the solutions showed that carbon dioxide caused conversion of 15 to 20 percent of the carbonate to bicarbonate, thus suggesting that the bicarbonate is the more corrosive species. If the sparging gas contained hydrogen sulfide, corrosion was less even if carbon dioxide was present, but in commercial plant usage, operating problems still resulted from corrosion. Bienstock and Field subsequently reported in Corrosion, Vol. 17, page 571*t* (1961) that 0.2 percent of sodium chromate or sodium metavanadate prevented some of the attack of ferrous metals although some pitting was noted in crevices with the chromate-inhibited solutions. U.S. Pat. No. 3,181,929 covers a similar or the same proposal. These investigators also tested potassium chromate, sodium metasilicate and potassium nitrite for this purpose.

Negra and McCloskey disclosed in U.S. Pat. No. 3,087,778 that trivalent compounds of arsenic, antimony, bismuth and phosphorus acted as inhibitors for both liquid and vapor corrosive attack.

Banks, in Material Protection, Vol. 6, page 37 (1967) studied the corrosivity of used solutions from gas absorption plant installations and laboratory-prepared solutions containing concentrations of potassium carbonate and potassium bicarbonate typical of those used in service. His polarization studies indicated that metavanadate salts passivate mild steel only if the bicarbonate level was low. Once passivated, however, the steel would remain so even if the carbonate were partly converted to bicarbonate by carbon dioxide. In tests simulating plant conditions, corrosion was greater under impingement conditions such as at elbows than when film disruptive conditions were absent. Under such conditions even stainless steel alloys may also be attacked.

In other prior art in this area, U.S. Pat. No. 2,761,765 suggests that small amounts of red iron oxide ($Fe_2O_3$) and/or alkali metal ferrites may alleviate this problem. U.S. Pat. No. 3,951,844 to Mago teaches that a mixture of a vanadium compound such as sodium metavanadate, with an antimony compound such as potassium antimonyl tartrate is effective as an anti-corrosion agent in this system. U.S. Pat. No. 3,041,135 discloses the use of petroleum sulfonates for this purpose while U.S. Pat. Nos. 3,721,526 and 3,863,003 teach the use of such anticorrosive agents as sodium nitrite and mixtures of sodium nitrite and sodium vanadate, respectively. However, to Applicants' knowledge none of these known corrosion inhibitors have been found to be sufficiently satisfactory for their purposes to meet these problems in the use of martensitic or ferritic stainless steel materials with hot alkali metal carbonate solutions.

SUMMARY OF THE INVENTION

It is accordingly one object of the present invention to provide a process and anti-corrosion system which overcomes or otherwise mitigates these problems of the prior art.

A further object of the present invention is to provide a method for the inhibition of corrosion in the use of martensitic and ferritic stainless steel structures which are in contact with hot alkali metal carbonate solutions.

A still further object of the present invention is to provide a method for the prevention of catastrophic corrosion problems in these stainless steel structures which are in continuous contact with hot alkali metal carbonate solutions by contacting said structures with nickel ion, either continuously or intermittently.

An even further object of the invention is to provide martensitic and ferritic stainless steel structures of the type which are exposed to hot alkali metal carbonate solutions, which stainless steel structures have been inhibited against corrosion by contact with nickel ion.

Further objects and advantages of the present invention will become apparent as the description thereof proceeds.

In satisfaction of the foregoing objects and advantages there is provided by this invention a method for the inhibition of corrosion of chromium stainless steel surfaces which are subjected to continuous exposure to hot solutions of alkali metal carbonates which comprise contacting said stainless steel surfaces with sufficient nickel ion to inhibit said corrosion.

DESCRIPTION OF PREFERRED EMBODIMENTS

The present invention is concerned with the prevention or inhibition of corrosion of surfaces of stainless steel structures of the type having a martensitic or ferritic metallurgical structure and which are subjected to more or less continuous exposure to hot alkali metal carbonate solutions such as heat exchangers. According to the present invention it has been found that such corrosion can be inhibited by contact with an inhibiting amount of nickel ion. The nickel ion is preferably provided as a soluble salt which can be dissolved in the carbonate solution and may be supplied either as dry crystals or as a solution of the nickel salt.

As indicated above, these types of stainless steel are utilized such as in heat exchange tubing or reboilers and the like, in processes wherein the surface of the stainless steel is in more or less continuous contact with hot alkali metal carbonate solutions. As a result, serious and often catastrophic corrosion problems often occur. Stainless steel structures are often constructed of so-called AISI type stainless steel materials. The following are representative compositions of stainless steels of this type, these being the martensitic Type 410 and austenitic Type 316 and ferritic Type 430. The compositions of these steels are typified as follows:

TABLE I

COMPOSITION OF STAINLESS STEELS
CHEMICAL ANALYSIS, PERCENT

| Component | AISI Type 410 (Martensitic) | AISI Type 316 (Austenitic) | AISI Type 430 (Ferritic) |
|---|---|---|---|
| Carbon | 0.15 max. | 0.08 max. | 0.12 max. |
| Chromium | 11.50 - 13.50 | 16.00 - 18.00 | 16.00 - 18.00 |
| Nickel | — | 10.00 - 14.00 | 0.50 max. |
| Manganese | 1.00 max. | 2.00 max. | 1.00 max. |
| Silicon | 1.00 max. | 1.00 max. | 0.75 max. |
| Phosphorus | 0.040 max. | 0.045 max. | 0.04 max. |
| Sulfur | 0.030 max. | 0.030 max. | 0.03 max. |
| Molybdenum | — | 2.00 - 3.00 | — |
| Iron | Balance | Balance | Balance |

It has been found that when stainless steels of the martensitic and ferritic types are subjected to more or less continuous contact with hot alkali metal carbonate solutions, the stainless steel is subject to corrosion, and in some cases to catastrophic corrosion because of the high concentrations of the alkali metal carbonate solutions and the high temperatures being utilized. These systems operate with alkali metal carbonate solutions having concentrations of 20 to 40 weight percent and temperatures in the almost continuous range from about 90° C. up to the boiling point of the aqueous solution containing the alkali metal carbonate. The alkali metal carbonate may be any carbonate such as sodium carbonate, potassium carbonate, sodium bicarbonate and potassium bicarbonate, as well as mixtures thereof. Usually, however, the solution is sodium or potassium carbonate at boiling temperatures.

According to the present invention, it has been found that the corrosive effect of these hot alkali metal carbonate solutions on the martensitic and ferritic stainless steel surfaces may be inhibited by including in the solution or otherwise contacting the stainless steel with an inhibiting amount of nickel ion. According to the present invention, the inhibiting amount of nickel ion included should be at least 10 parts per million since this amount has been found necessary to achieve inhibiting results. The range of nickel ion which may be present in the solution is preferably 15 ppm but may range from 10–20 ppm although there is no necessary upper limit on the amount of nickel ion which may be present except for economic reasons. The nickel ion is preferably supplied as a water soluble salt such as nickel chloride, nickel nitrate, nickel sulfate, mixtures thereof and the like. The nickel salt may be supplied as dry crystals or as an aqueous solution of the nickel salt in any desired concentration.

It has been found that the addition of the specified amounts of nickel ion to the hot carbonate solution has the effect of substantially reducing the corrosive effect of the carbonate solution on these stainless steels. Moreover, in situations where catastrophic corrosion has been initiated such that the corrosion rate exceeds 200 mpy, the addition of 15 ppm of nickel ion will quickly reduce the corrosion rate to less than 5 mpy (mils per year), a standard method of measuring corrosion, as described for example in U.S. Pat. No. 3,951,844.

The nickel ion may be supplied to achieve the corrosion inhibiting characteristics by dissolution of the nickel salt in the carbonate solution or by immersing the stainless steel surfaces directly in a solution of the nickel ion or immersion in an alkali carbonate solution containing the nickel ion.

Since the continuous addition of nickel ion to the system may result in an accumulation of nickel in the product and thereby contaminate the product, it is preferable according to the invention that nickel ion not be continuously added as a corrosion inhibitor. Accordingly, in a further and preferred embodiment of the invention, the nickel ion is added to the system as the need dictates, that is when the corrosion rate exceeds an allowable mpy maximum value. Thus, this has the effect of not only preventing the accumulation of nickel ion in the system but also reduces the economic costs of using the nickel ion in the system. Therefore, it should be understood that in practicing the present invention it is only necessary to insure that the corrosion rate of the stainless steel is monitored and when the corrosion rate exceeds a set limit, sufficient nickel ion is added to the hot alkali metal carbonate solution to inhibit the corrosion and reduce the corrosion rate to a safe level.

Although the resulting pick-up of nickel ion by martensitic and ferritic stainless steels serves satisfactorily to reduce corrosion, the stress-corrosion cracking characteristic of austenitic stainless steel is avoided.

The following examples are presented to illustrate the invention but it is not to be considered as limited thereto. In the following examples parts are by weight unless otherwise indicated.

EXAMPLE I

In the following example the effect of nickel ion addition on the corrosion rate of a stainless steel surface was investigated. This example was concerned with prevention of corrosion. The stainless steel is an AISI type SS-430 having the analysis described above in Table I.

In the tests of this example, the corrosive carbonate solution contained 28.0% sodium carbonate, 4.5% sodium bicarbonate and 0.1% sodium chloride. The temperature of the carbonate solution which was in contact with the SS-430 stainless steel was 102° C.

In this example, the corrosion rate of the stainless steel was based on exposure time and a comparison was made between the corrosion rate without nickel ion addition and the corrosion rate with nickel ion addition. The results of this experiment are set forth in the following Table.

TABLE II

| Nickel Ion Addition (ppm) | SS-430 Exposure Time (hours)* | SS-430 Corrosion Rate (mpy) |
|---|---|---|
| 0 | 1 | >200 |
| 0 | 2 | >200 |
| 0 | 16 | >200 |
| 15 | 1 | <5 |
| 15 | 2 | <2 |
| 15 | 16 | <1 |

*Elapsed time since freshly-pickled SS-430 immersed in corrosive solution.

As may be seen from the above Table, the corrosion rate without nickel ion addition was greater than 200 mpy. With nickel ion addition to the carbonate solution, the rate of corrosion dropped to less than 5 mpy after one hour, less than 2 mpy after 2 hours, and less than 1 mpy after 16 hours.

EXAMPLE II

In the following example the effect of nickel ion in the system on an actively corroding stainless steel was investigated. The stainless steel was the same SS-430 stainless steel of Example I and the corrosive carbonate solution contained 28.0% sodium carbonate, 4.0% sodium bicarbonate and 0.5% sodium chloride. The temperature of the carbonate solution was 102° C.

In this example, the stainless steel was actively corroding and the corrosion rate was determined and checked based on the amount of nickel added. The results of this experiment are set forth in the following Table.

TABLE III

| SS-430 Exposure Time (hours)* | SS-430 Corrosion Rate (mpy) |
|---|---|
| 1 | >200 |
| 1+ | ** |
| 2 | <5 |

TABLE III-continued

| SS-430 Exposure Time (hours)* | SS-430 Corrosion Rate (mpy) |
|---|---|
| 3 | <2 |

*Elapsed time since freshly-pickled SS-430 immersed in corrosive solution.
**15 ppm nickel ion added to corrosive solution containing actively-corroding SS-430.

As may be seen from the Table, addition of 15 ppm of nickel ion to the hot carbonate solution slowed the corrosion rate from greater than 200 mpy to less than 2 mpy after 3 hours.

The invention has been described herein with reference to certain preferred embodiments; however, as obvious variations thereon will become apparent to those skilled in the art, the invention is not to be considered as limited thereto.

What is claimed is:

1. The method for the inhibition of corrosion of martensitic or ferritic stainless steel being contacted with aqueous hot alkali metal carbonate solutions which comprises contacting such stainless steel with an inhibiting amount of nickel ion.

2. A method according to claim 1 wherein the hot alkali metal carbonate solution contains an alkali metal carbonate selected from the group consisting of sodium carbonate, sodium bicarbonate, potassium carbonate, potassium bicarbonate, and mixtures thereof.

3. A method according to claim 1 wherein the stainless steel is contacted with the nickel ion by immersion in a solution of a nickel salt.

4. A method according to claim 1 wherein the stainless steel is contacted with the nickel ion by immersion in a solution of hot alkali metal carbonate solution containing a soluble nickel salt.

5. A method according to claim 1 wherein an inhibiting amount of nickel ion is added to a hot alkali metal carbonate solution after the onset of corrosion.

6. A method according to claim 1 wherein said nickel ion is added intermittently as the corrosion rate is monitored and an inhibiting amount of nickel ion is added when the corrosion rate exceeds a set limit.

7. A method according to claim 1 wherein said nickel ion is added as a soluble nickel salt selected from the group consisting of nickel chloride, nickel nitrate, nickel sulfate and mixtures thereof.

8. A method according to claim 7 wherein the nickel is added as nickel chloride.

9. A method according to claim 7 wherein the nickel is added as nickel nitrate.

10. A method according to claim 7 wherein the nickel is added as nickel sulfate.

11. A method according to claim 1 wherein the inhibiting amount of nickel ion is added as a soluble nickel salt to the hot alkali metal carbonate solution.

12. A method according to claim 11 wherein at least 10 ppm of nickel ion are added to the hot carbonate solution.

13. A method according to claim 12 wherein 10 ppm to 20 ppm of nickel ion are added to said carbonate solution.

* * * * *